US006939240B2

(12) United States Patent
Daley

(10) Patent No.: US 6,939,240 B2
(45) Date of Patent: Sep. 6, 2005

(54) GOLF PUTTING DEVICE

(76) Inventor: Richard A. Daley, 118 Elmdale Rd., N. Scituate, RI (US) 02857

( * ) Notice: Subject to any disclaimer, the term of this patent is extended or adjusted under 35 U.S.C. 154(b) by 0 days.

(21) Appl. No.: 10/762,692

(22) Filed: Jan. 22, 2004

(65) Prior Publication Data

US 2004/0152530 A1 Aug. 5, 2004

Related U.S. Application Data

(60) Provisional application No. 60/442,025, filed on Jan. 23, 2003.

(51) Int. Cl.[7] ..... A63B 69/36
(52) U.S. Cl. ..... 473/180; 473/193
(58) Field of Search ..... 473/150–196

(56) References Cited

U.S. PATENT DOCUMENTS

| | | | | | |
|---|---|---|---|---|---|
| 954,229 | A | | 4/1910 | Johnson | |
| 1,135,706 | A | | 4/1915 | Mahe | |
| 1,485,089 | A | | 2/1924 | Musselman | |
| 1,611,660 | A | | 12/1926 | Manly | |
| 3,669,454 | A | | 6/1972 | Kolonel | |
| 3,806,132 | A | | 4/1974 | Brandell | |
| 3,891,221 | A | | 6/1975 | Gordon | |
| 4,244,576 | A | * | 1/1981 | Mosier et al. | 473/159 |
| 4,995,617 | A | | 2/1991 | Lee | |
| 5,171,016 | A | * | 12/1992 | Kamal | 473/160 |
| 5,205,559 | A | | 4/1993 | Plopper | |
| 5,282,626 | A | | 2/1994 | Millar | |
| 5,383,665 | A | * | 1/1995 | Schultz et al. | 473/159 |
| 5,435,560 | A | * | 7/1995 | Kehoe | 473/180 |
| 5,487,545 | A | | 1/1996 | Schindler | |
| 5,538,253 | A | * | 7/1996 | Foster | 273/108.21 |
| 5,586,941 | A | | 12/1996 | Klearman | |
| 5,645,492 | A | | 7/1997 | Anderson | |
| 5,690,557 | A | | 11/1997 | Casillas et al. | |
| 5,735,751 | A | | 4/1998 | Pacheco | |
| 5,749,789 | A | * | 5/1998 | Karl | 473/162 |
| 5,857,919 | A | * | 1/1999 | Hoyt et al. | 473/184 |
| 5,971,863 | A | * | 10/1999 | Durso | 473/159 |
| 5,997,406 | A | | 12/1999 | Selton | |
| 6,004,219 | A | * | 12/1999 | Peabody | 473/157 |
| 6,283,873 | B1 | * | 9/2001 | Nunes | 473/180 |
| 6,419,590 | B1 | * | 7/2002 | Criger | 473/174 |
| 2004/0092325 | A1 | * | 5/2004 | Brown | 473/176 |

FOREIGN PATENT DOCUMENTS

| | | |
|---|---|---|
| JP | 09075495 | 3/1997 |

OTHER PUBLICATIONS

"No Bogie Practice Cup", *Shot Savers Golf*, [on line sales information]. Retrieved from the Internet Mar. 31, 2003. <URL:http://www.shotsavers.com/store/merchant/mv?Screen=PROD&Store_Code=SE&Product . . . >.

"No 3 Putt Cup Reducer", *Shot Savers Golf*, [on line sales information]. Retrieved from the Internet Mar. 31, 2003. <URL:http://www.shotsavers.com/store/merchant/mv?Screen=PROD&Store_Code=SE&Product . . . >.

"Dave Pelz Truthboard", *Shot Savers Golf*, [on line sales information]. Retrieved from the Internet Mar. 31, 2003. <URL:http://www.shotsavers.com/store/merchant/mv?>.

"Fuzzy Zoeller's Putting Pod /Peg", *Shot Savers Golf*, [on line sales information]. Retrieved from the Internet Mar. 31, 2003. <URL:http://www.shotsavers.com/store/merchant/mv?Screen=PROD&Store_Code=SE&Product . . . >.

(Continued)

*Primary Examiner*—Mark S. Graham
(74) *Attorney, Agent, or Firm*—Hamilton, Brook, Smith & Reynolds, P.C.

(57) ABSTRACT

An improved portable putting cup is disclosed that more effectively reproduces an accurate representation of a regulation putting cup for practice putting.

12 Claims, 7 Drawing Sheets

OTHER PUBLICATIONS

"Birdiemaster", Shot Savers Golf, [on line sales information]. Retrieved from the Internet Mar. 31, 2003. <URL:http://www.shotsavers.com/store/merchant/mv?Screen=PROD&Store_Code=SE&Product . . . >.

"Zen Oracle Training Putter", *Shot Savers Golf*, [on line sales information]. Retrieved from the Internet Mar. 31, 2003. <URL:http://www.shotsavers.com/store/merchant/mv?Screen=PROD&Store_Code=SE&Product . . . >.

"The Boomerang: Eliminate 3 putts FOREVER! Makes putting practice . . . " BoomGolf.com, [on line sales information]. Retrieved from the Internet Mar. 31, 2003. <URL:http://www.shotsavers.com/store/merchant/mv?Screen=PROD&Store_Code=SE&Product . . . >.

"Golf Putting Cup", *Office Playground*, [on line sales information]. Retrieved from the Internet Jan. 22, 2003. <URL:http://www.officeplayground.com/golfputting.html>.

"Golf Puttting Key 8975", *HSI online*, [on line sales information]. Retrieved from the Internet Jan. 22, 2003. <URL:http://www.hsionline.com/products/ecbuilder2/item4918.htm>.

"Putting tool helps to improve game", *Agusta Chronicle*, [on line sales information]. Retrieved from the Internet Jan. 22, 2003. <URL:http://www.augustachronicle.com/stories/041098/met_AIK–3131.001.shtml>.

"Foam Putting Cups", *Palos Sports*, [on line sales information]. Retrieved from the Internet Jan. 22, 2003. <URL:http://www.palossports.com/store/proddetail.cfm/ItemID/152/CategoryID/49/SubCatID/43 . . . >.

"Golf Putting Pal", *BaronBob*&Wonderfullywacky.com, [on line sales information]. Retrieved from the Internet Jan. 22, 2003. <URL:http://www.wonderfullywackie.com/golfputtingpal.htm>.

"Golf Gifts & Galleries Executive Putting System", *The Sports Authority*, [on line sales information]. Retrieved from the Internet Jan. 22, 2003. <URL:http://www.thesportsauthority.com/product/index.jsp?productID=239522>.

"Putter Pal Laser Alignment Training Device Attaches To Your Putter", *1999 Sports Tech Group Inc. and Golf Link Inc.*, [on line sales information]. Retrieved from the Internet Mar. 31, 2003. <URL:http://www.sportstechgroup.com/ . . . >.

* cited by examiner

GOLF PUTTING DEVICE

RELATED APPLICATION

This application claims the benefit of U.S. Provisional Application No. 60/442,025, filed Jan. 23, 2003. The entire teachings of the above application are incorporated herein by reference.

BACKGROUND

The game of golf is and has been enjoyed by thousands of people around the world. To become good at this game, many people practice. One area of practice is in the area of putting. Every golfer knows that improving your putting will lower your scores, yet it has long been one of the most elusive goals to achieve in golf.

Golfers typically practice putting wherever they can find a suitable surface, either outdoors or indoors. In many cases, a carpeted surface indoors must suffice for practice putting for reasons of inclement weather, time or convenience. In these and similar cases, the golfer has a need for a visually representative putting target that provides feedback on both the line and speed of the practice stroke similar to an actual golf hole. A practice set-up is preferred that does not impede the natural movement of the golf ball significantly.

Many devices that aid in the practice of putting have been created. These devices have tended to be mechanically complicated, expensive to manufacture, or lacked the necessary feedback to indicate to the golfer that the ball was optimally stroked. That is, not only on line but equally as important, at the correct speed to have the greatest chance of being captured by the hole.

To try to meet the need, attempts have been made to produce a putting cup for indoor/outdoor use that would simulate a natural putting cup on a standard putting green. However, there are still some major problems with the putting devices that exist today. For example, many existing devices often have a rear wall or obstruction that prevents a ball putted with too much speed from overshooting the hole, while other putting aides do not provide a realistic feel for the putting speed because they incorporate an exaggerated or raised area towards the cup to provide space for a hole.

SUMMARY

The instant invention relates to an improved portable putting cup that more effectively reproduces an accurate representation of a regulation putting cup for practice putting.

In one embodiment, a golf practice putting device comprises a first member having an opening approximately the size of a regulation golf hole and a second member having a surface area larger than the opening on the first member. The second member has adhesive properties on the top surface and the first member is affixed to the adhesive top surface of the second member with the opening exposing the adhesive properties of the second member such that a golf ball putted towards the device can adhere to the adhesive top surface of the second member. The first member and the second member can have a substantially flat surface area. In a particular embodiment, the first member of the device is comprised of a material such as plastic, cardboard, metal, and paper, or other suitable material whereas the second member has an adhesive surface similar to tacky-type tape, such as duct tape. Further, the second member includes a front end, a rear end, and a bottom surface, the front end and the rear end defining an incline with respect to the bottom surface. Alternatively, a third member can be provided to create an incline to support the first and second members.

In another embodiment, a golf practice putting device comprises a first member having a diameter approximately the size of a regulation golf hole. In this embodiment, the flat member can have an adhesive top surface affixed wherein a golf ball putted towards the device with the proper speed can roll onto and adhere to the adhesive top surface.

In another embodiment, a golf practice putting device comprises a housing having an open position and a closed position. The housing can have an interior located surface approximately the size of a regulation golf hole which has adhesive properties such that when the housing is in the open position and placed on a flat surface, the interior surface of the housing is exposed and a golf ball putted towards the device can adhere to the adhesive surface of the housing. In a further embodiment, the housing comprises two members which can be attached by a hinge such that when the housing is in the closed position the two members are joined to form an enclosure. In a further embodiment, the adhesive properties of the surface on the device is similar to tacky-type tape, such as duct tape.

In another embodiment, a golf practice putting device comprises a housing having an open position and a closed position and can have a diameter approximately the size of a regulation golf hole. In this embodiment, the housing includes a pair of circular members which can be attached by a hinge. One of the housing members has an adhesive surface on one interior side of the member such that when the housing is in the open position and placed on a flat surface, the interior adhesive surface is exposed, and a golf ball putted towards the device can adhere to the adhesive surface. In a further embodiment, the housing comprises two members which can be attached by a hinge such that when the housing is in the closed position the two members are joined to form an enclosure.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

A description of preferred embodiments of the invention follows.

This description relates to a device for the practice of putting in the game of golf. Generally, the device simulates a golf hole which is found on the putting green at a golf course. An advantage of the present approach is that the device neither requires a great deal of depth as a real golf hole does nor a mechanism that requires substantial cost, parts or size. The present approach provides a means of simulating a golf hole without actually having a hole in the ground or an exaggerated elevated surface in which to place a recess, hole, or mechanism.

Figure 1B:
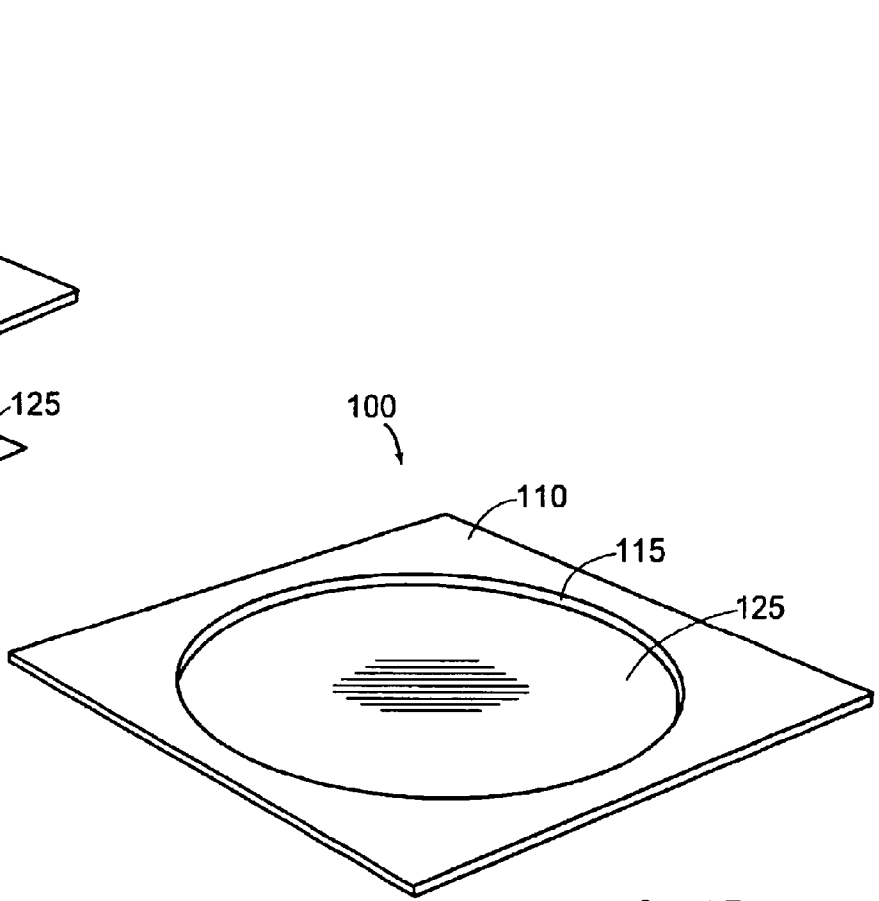
FIG. 1B shows the embodiment of FIG. 1A wherein the two members are joined together to present a simulation golf hole for practice.
Figure 1A:
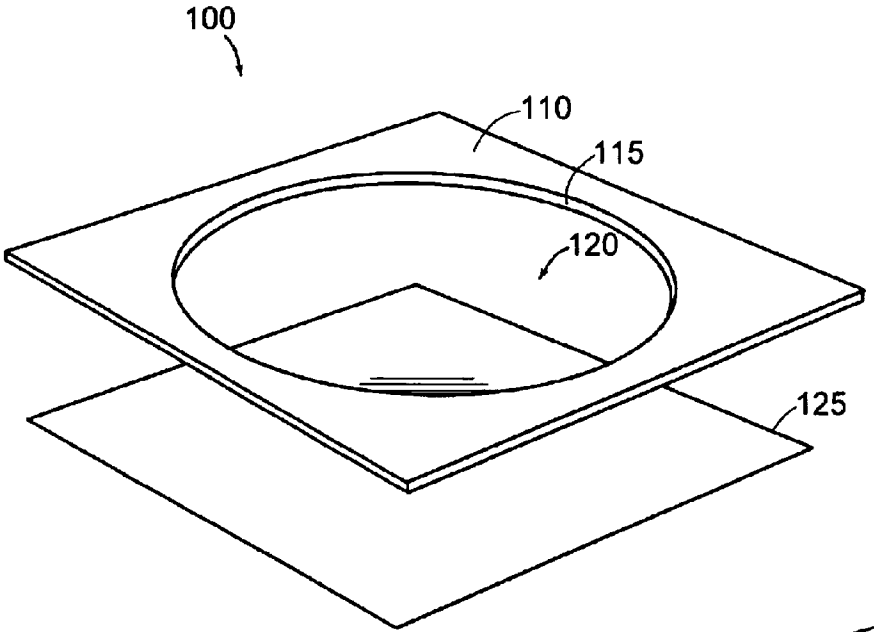
FIG. 1A shows an exploded perspective view of an embodiment of a putting device having two members.

FIGS. 1A and 1B depict one embodiment of the present invention. In this embodiment, the golf practice putting device 100 comprises two members 110 and 125. The length and width of the first member 110 is greater than the diameter of a regulation golf hole, for example the United States Golf Association rules state "a hole shall be 4¼ inches diameter." Within this member is an opening 120 approximately the diameter of a regulation golf hole. The outer shape of member 110 can be square, round, or any other shape. The second member 125 has a surface area larger than the opening 120 on the first member 110. This second member 125 preferably has adhesive characteristics such as that of a piece of tacky-type tape, such as duct tape. Preferably, the device 100 has the thickness or height of a thin piece of plastic, cardboard, metal, paper, or other thin material. For example, the thin material can have a height or thickness ranging from approximately 0.015 inches to 0.035 inches. In one embodiment, the thin material has a height or thickness of approximately 0.020 inches. The first member 110 is affixed to the adhesive side of the second member 125 such that the opening 110 exposes the adhesive properties of the second member 125. In use, the device 100 is placed on a flat surface with the adhesive side face up.

Figure 2:
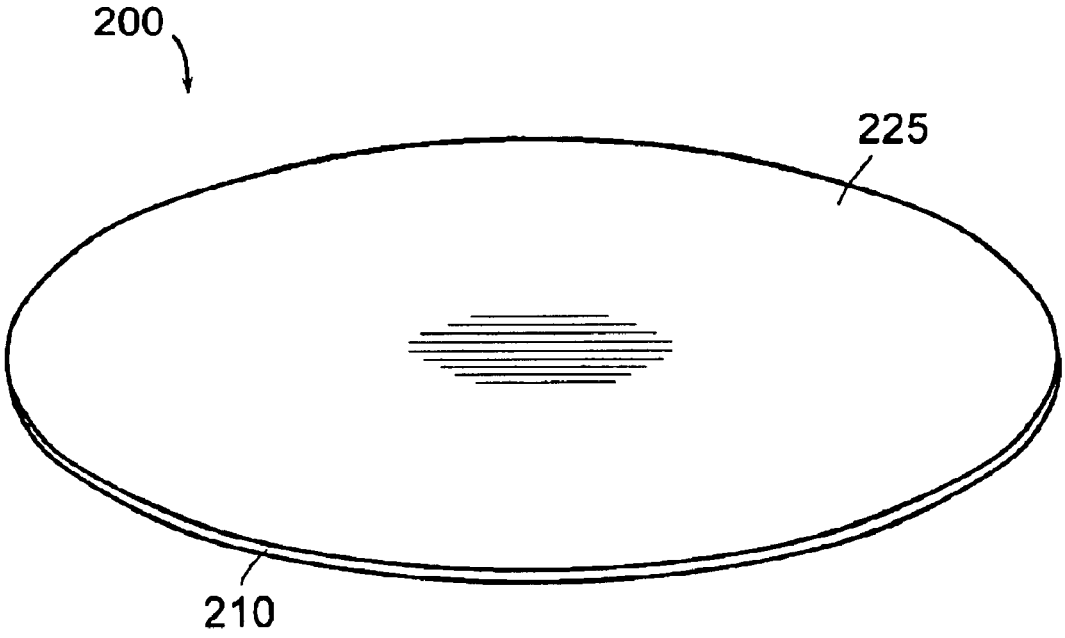
FIG. 2 shows a perspective view of a second embodiment of a putting device having one member with adhesive covering one side of the member.
Figures 3A, 3B:
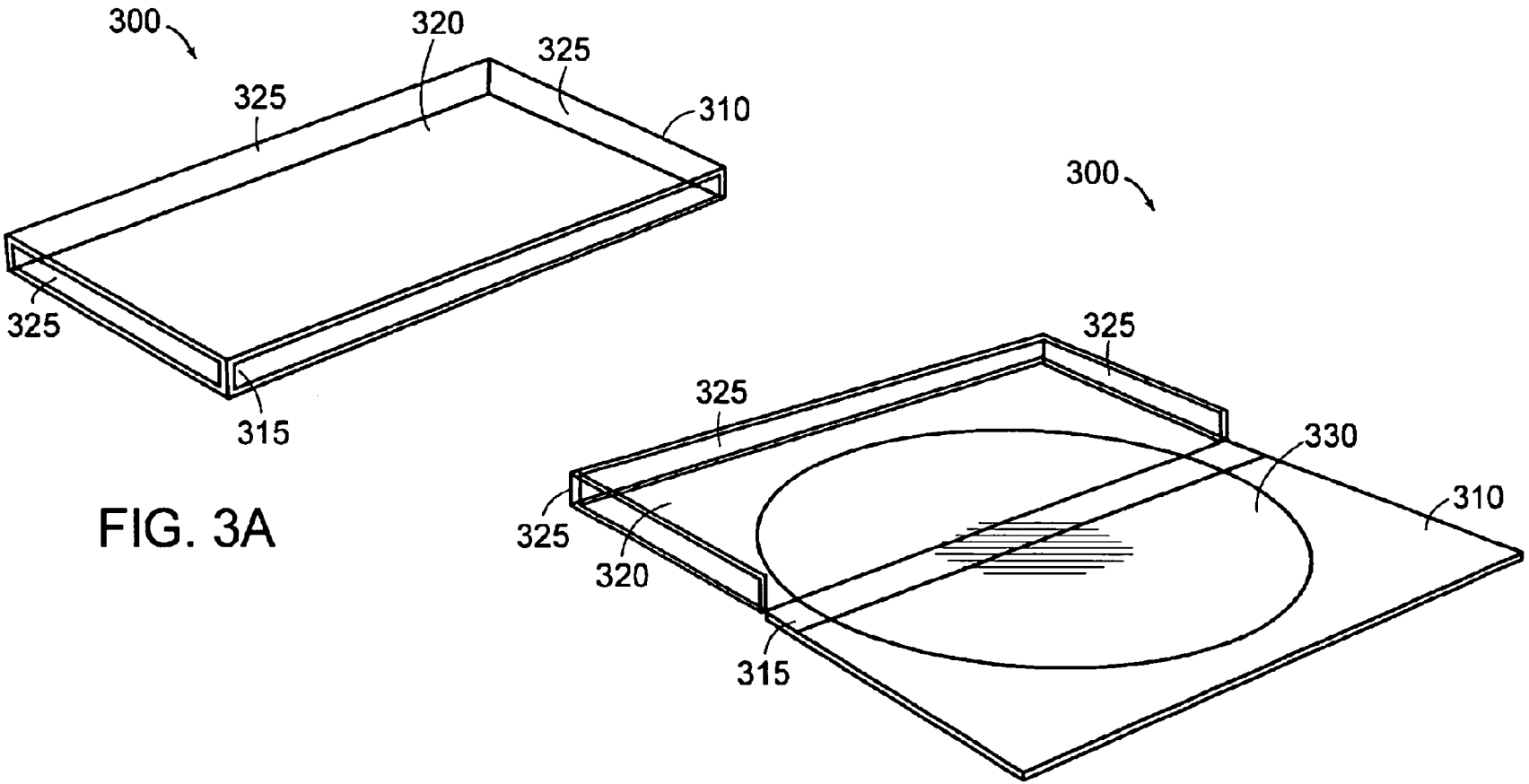
FIG. 3A shows a perspective view of a third embodiment of a putting device comprising a housing in the closed position in which the circle simulating the golf hole is enclosed for travel and/or storage.
FIG. 3B shows a perspective view of the third embodiment of FIG. 3A wherein the housing is in the open position in which the circle simulating the golf hole is presented to aid in putting practice.
Figure 4B:
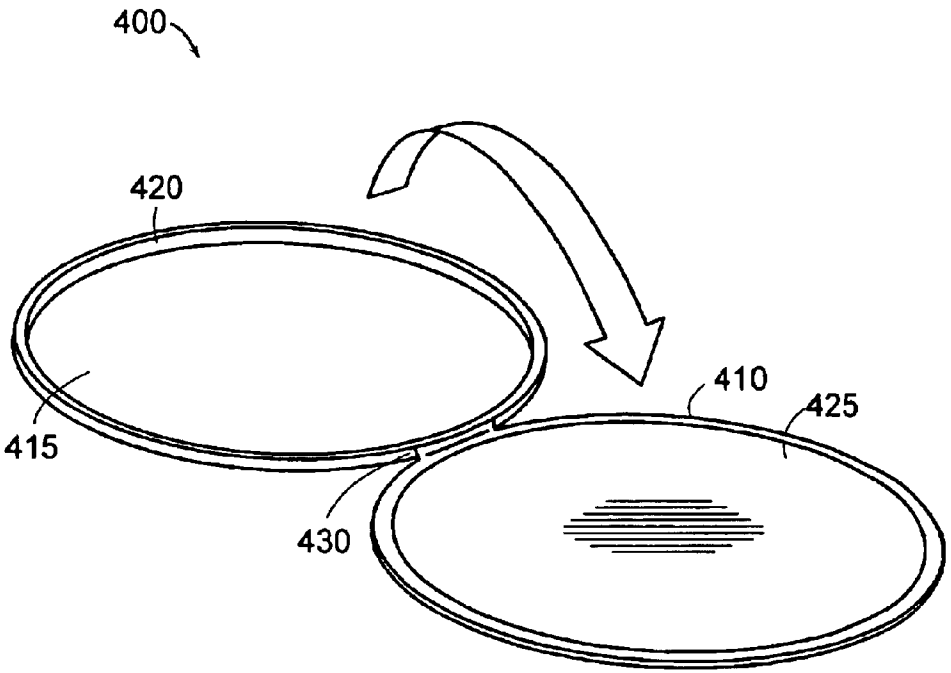
FIG. 4B shows a perspective view of the fourth embodiment of FIG. 4A wherein the housing is in the open position.
Figure 4A:
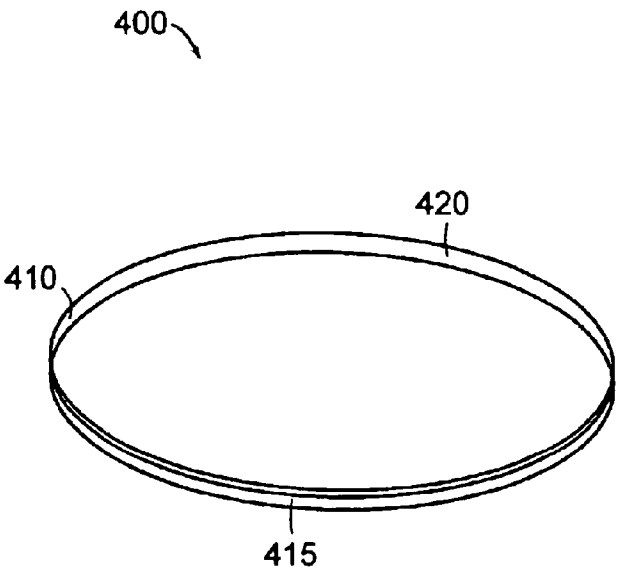
FIG. 4A shows a perspective view of a fourth embodiment of a putting device comprising a housing in the closed position.

FIG. 2 depicts another embodiment of the present invention. In this embodiment, the golf practice putting device 200 comprises a member 210 having a diameter the same as or greater than the size of a regulation golf hole. For embodiments in which the member has a diameter approximately the same size as a regulation golf hole, then one surface 225 has adhesive characteristics of tacky-type tape, such as duct tape. For other embodiments in which the diameter of the member 210 is greater than a regulation golf hole, on one side of the member, preferably centered, a surface 225 is located having a diameter approximately the same size as a regulation golf hole. The surface 225 has adhesive characteristics of, tacky-type tape, such as duct tape. In use, the device 200 is placed on a flat surface with the adhesive side face up.

FIGS. 3A–3B and 4A–4B depict further embodiments of the present invention that provide a housing for the golf practice putting device. The outer shape of housing 300 and/or 400 can be rectangle, square, circle, or any other shape. For example, in one embodiment, the housing 300 can comprise two distinct members 310, 320 that are held together by a hinge 315. Hinge 315 can be a living hinge or a mechanical hinge and can be either a single or double living hinge. In this embodiment, member 310 is a flat, thin material with no sides, while the other member 320, which can also be made of a thin material, has sides 325 such that when the housing 300 is in the closed position the two members 310, 320 join together to form an enclosure (see FIG. 3A). Alternatively, the housing 320 can comprise one member that folds back upon itself at a hinge.

In the closed position the housing 300 can have a diameter that is less than, the same as or greater than the size of a regulation golf hole. Regardless of the size and shape of the members 310, 320 of the housing 300, the housing 300 in the open position presents a surface 330 having a diameter approximately the same size as a regulation golf hole. The surface 330 has adhesive characteristics of, tacky-type tape, such as duct tape.

In another embodiment, the housing 400 (FIGS. 4A and 4B) can comprise two distinct circular members 410 and 415 that are held together by a hinge 430. Although circular members are described any shaped known in the art can be used, for example, but not limited to the shapes of a square, an oval, or a ring may be used. Hinge 430 can be a living hinge. In this embodiment, member 410 is a flat, thin material with no sides, while the other member 415, which can also be made of a thin material, has sides or rim 420 such that when the housing 400 is in the closed position the two members 410, 415 join together to form an enclosure (see FIG. 4A). Regardless of the size of the members 410, 415 of the housing 400, the housing 400 in the open position presents a surface 425 having a diameter approximately the same size as a regulation golf hole. The surface 425 has adhesive characteristics of, tacky-type tape, such as duct tape.

Figure 5B:
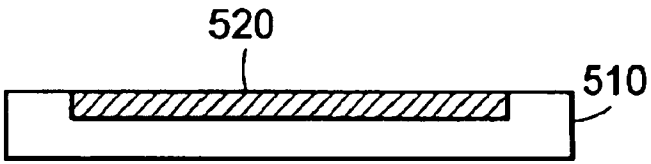
FIG. 5B shows a cross-sectional view of a putting device having a recessed member with an adhesive material attached.
Figure 5A:
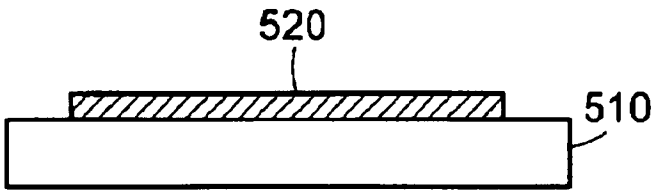
FIG. 5A shows a cross-sectional view of a putting device having a flat member with an adhesive material attached.

In all embodiments, a removable non-adhesive covering can be removably affixed to the top of the adhesive surface. Also, the housings of FIGS. 3 and 4 can be made in two separate pieces such that a hinge is not needed. Further, as shown in FIGS. 5A and 5B, the members 510 which contain the adhesive material 520 can be made to be flat or recessed.

To use embodiments of the invention, the device 100 (FIGS. 1A and 1B), for example, is placed a desired distance from the user for the desired type of putting practice. The user then putts a golf ball towards the device 100 in a manner as if putting on a real golf course. A golf ball putted in the proper direction and with the proper speed proceeds toward the center of the opening 120 which simulates the golf hole. The properly putted golf ball rolls over the thin material that comprises the device until it hits the edge 115 where the opening begins. The putted ball then proceeds to roll over this edge 115 onto the adhesive surface 125 where it will stop rolling due to the sticky adhesive qualities of the surface. If the ball is not putted properly it will continue to roll off the adhesive surface 125.

The same principle works if the hole size is slightly smaller or larger. By changing the size of the opening, in particular by making the opening smaller, the device can be used to teach the user to become a more accurate putter by presenting a smaller target. The surface having the adhesive properties and simulating a golf hole can be smaller in diameter than a regulation golf hole to improve the user's putting skills.

A benefit of the present approach is that it can not only provide a directional aide to putting but it can also provide training for gauging the right amount of speed for putting a ball.

Another advantage of the present invention is that it provides a minimal amount of size which can be useful for travel and convenience of storage. The device also contains no moving mechanism or parts that might add substantial cost. Additionally, because the device is inexpensive to manufacture, the device can be disposed of and replaced or the adhesive piece of the device can be replaced if the adhesive loses tackiness.

Figure 6:
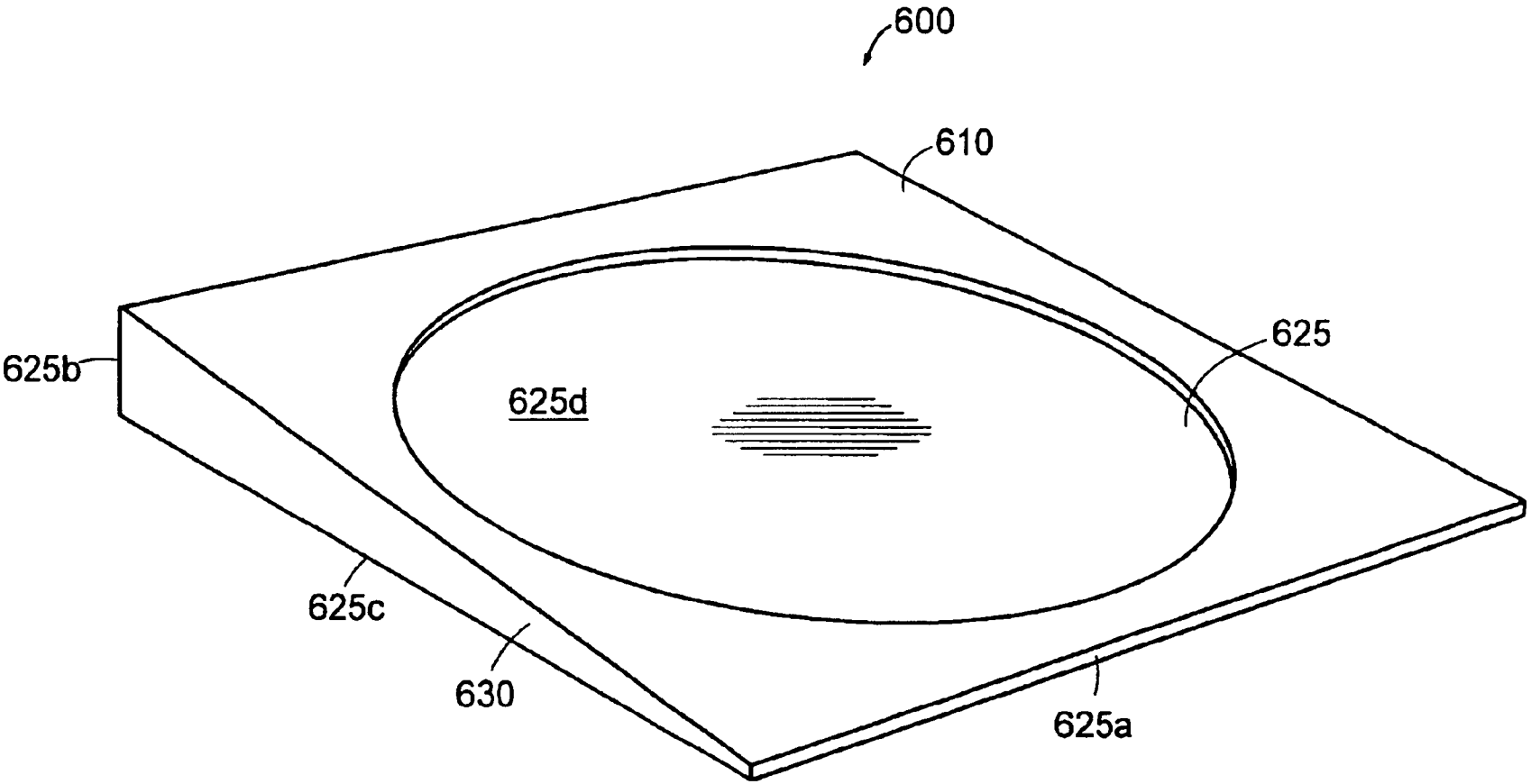
FIG. 6 shows a perspective view of a fifth embodiment of a putting device comprising a first member and a second member joined together, the second member creating an incline to present an inclined simulation golf hole for practice.

FIG. 6 shows another embodiment of the present invention having an incline to simulate putting up an inclined surface. In this embodiment, the golf practice putting device 600 comprises two members 610 and 625. Member 625 includes a front end 625*a*, a rear end 625*b*, a bottom surface 625*c*, and a top surface 625*d*. The front end 625*a* and rear end 625*b* create an angle 630 with respect to the bottom surface 625*c* and the top surface 625*d*. All other aspects of the two members 610 and 625 are analogous to members 110 and 125 of FIGS. 1A and 1B.

Figure 7:
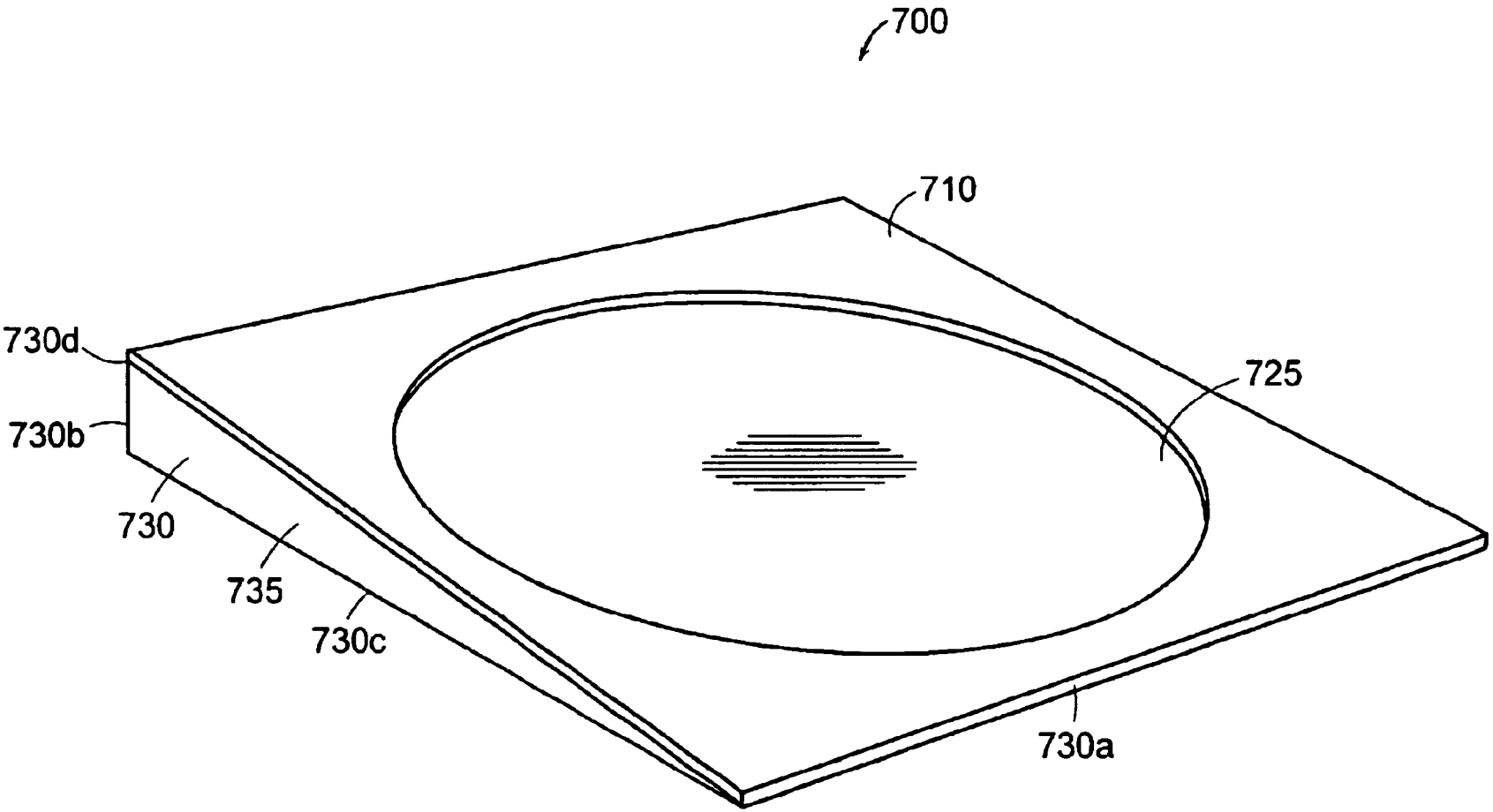
FIG. 7 shows a perspective view of a sixth embodiment of a putting device comprising a first member, a second member, and a third member joined together, the third member creating an incline to present an inclined simulation golf hole for practice.

FIG. 7 shows another embodiment of the present invention having an incline to simulate putting up an inclined surface. In this embodiment, the golf practice putting device 700 comprises three members 710, 725, and 730. Member 730 includes a front end 730*a*, a rear end 730*b*, a bottom surface 730*c*, and a top surface 730*d*. The front end 730*a* and rear end 730*b* create an angle 735 with respect to the bottom surface 730*c* and the top surface 730*d*. Member 730 can be affixed to either member 710 or 725 alone or in combination. All other aspects of the two members 710 and 725 are analogous to members 110 and 125 of FIGS. 1A and 1B.

While this invention has been particularly shown and described with references to preferred embodiments thereof, it will be understood by those skilled in the art that various changes in form and details may be made therein without departing from the scope of the invention encompassed by the appended claims.

What is claimed is:

1. A golf practice putting device comprising:

a first member having an opening approximately the size of a regulation golf hole;

a second member having a surface area larger than the opening on the first member, the second member having adhesive properties on a top surface, the first member affixed to the adhesive top surface of the second member with the opening exposing the adhesive properties of the second member, such that a golf ball putted towards the device can adhere to the adhesive top surface of the second member;

wherein the second member includes a front end, a rear end, a bottom surface, and a top surface, the front end and the rear end creating an angle with respect to the bottom surface and the top surface.

2. The device of claim 1, wherein the first member is comprised of a material selected from the group consisting of plastic, cardboard, metal, and paper.

3. The device of claim 1, wherein the adhesive properties of the second member are similar to tacky-type tape, such as duct tape.

4. The device of claim 1, wherein the thickness of the device is in a range of approximately 0.015 inches to 0.035 inches.

5. The device of claim 1, wherein the golf ball putted towards the device adheres to the adhesive top surface when the golf ball is putted with a correct speed.

6. The device of claim 1, wherein the first member and the second member have a substantially flat surface area.

7. A golf practice putting device comprising:

a first member having an opening approximately the size of a regulation golf hole;

a second member having a surface area larger than the opening on the first member, the second member having adhesive properties on a top surface, the first member affixed to the adhesive top surface of the second member with the opening exposing the adhesive properties of the second member, such that a golf ball putted towards the device can adhere to the adhesive top surface of the second member; and a third member, the third member includes a front end, a rear end, a bottom surface and a top surface, the front end and the rear end creating an angle with respect to the bottom surface and the top surface.

8. The device of claim 7, wherein the first member is comprised of a material selected from the group consisting of plastic, cardboard, metal, and paper.

9. The device of claim 7, wherein the adhesive properties of the second member are similar to tacky-type tape, such as duct tape.

10. The device of claim 7, wherein the thickness of the device is in a range of approximately 0.015 inches to 0.035 inches.

11. The device of claim 7, wherein the golf ball putted towards the device adheres to the adhesive top surface when the golf ball is putted with a correct speed.

12. The device of claim 7, wherein the first member and the second member have a substantially flat surface area.

* * * * *